US010172456B2

(12) United States Patent
Gaschy et al.

(10) Patent No.: US 10,172,456 B2
(45) **Date of Patent: *Jan. 8, 2019**

(54) WORK AND DISCUSSION SPACE

(71) Applicant: STEELCASE INC., Grand Rapids, MI (US)

(72) Inventors: Bryony Gaschy, Oberhausbergen (FR); Jessie Storey, Munich (DE)

(73) Assignee: STEELCASE INC., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/636,924

(22) Filed: Jun. 29, 2017

(65) Prior Publication Data

US 2017/0295929 A1 Oct. 19, 2017

Related U.S. Application Data

(63) Continuation of application No. 15/164,157, filed on May 25, 2016, which is a continuation of application No. PCT/FR2013/053132, filed on Dec. 17, 2013.

(51) Int. Cl.

| | |
|---|---|
| ***A47B 83/02*** | (2006.01) |
| ***A47B 83/00*** | (2006.01) |
| ***A47B 21/02*** | (2006.01) |
| ***E04B 2/74*** | (2006.01) |

(52) U.S. Cl.

CPC ..... *A47B 83/001* (2013.01); *A47B 21/02* (2013.01); *A47B 83/02* (2013.01); *E04B 2/7401* (2013.01); *A47B 2083/003* (2013.01); *A47B 2200/0071* (2013.01); *E04B 2002/7483* (2013.01)

(58) Field of Classification Search

CPC ..... E04B 2001/7483; E04B 2/7401; A47B 21/02; A47B 83/02; A47B 83/003

USPC ..... 52/550; 297/245

See application file for complete search history.

(56) References Cited

U.S. PATENT DOCUMENTS

| | | | | | |
|---|---|---|---|---|---|
| D56,367 | S | * | 10/1920 | Leijen | 297/184.14 |
| D155,624 | S | * | 10/1949 | Pahlmann | 297/135 |
| D190,904 | S | * | 7/1961 | Kasparian | D6/336 |
| D247,595 | S | * | 3/1978 | Corson | D6/381 |
| 4,856,242 | A | | 8/1989 | Baloga et al. | |
| 4,986,194 | A | | 1/1991 | Bollman | |
| 5,765,315 | A | | 6/1998 | Nagamitsu | |
| 6,474,025 | B1 | | 11/2002 | Falks | |
| D480,883 | S | * | 10/2003 | Williams | D6/334 |
| D484,709 | S | * | 1/2004 | Cronk | D6/336 |
| D513,564 | S | * | 1/2006 | Nobles | D6/332 |
| 7,117,802 | B2 | | 10/2006 | Hoke, Jr. | |
| 8,118,365 | B2 | | 2/2012 | Henshaw | |
| D675,458 | S | * | 2/2013 | Martin | D6/381 |
| 8,534,752 | B2 | * | 9/2013 | Martin | A47B 3/06 108/50.11 |
| D698,564 | S | * | 2/2014 | Behar | D6/381 |

(Continued)

*Primary Examiner* — Paola Agudelo

(74) *Attorney, Agent, or Firm* — Brinks Gilson & Lione

(57) ABSTRACT

A work and discussion space includes two installation blocks that are positioned opposite one another. Each installation block accommodates two people and includes a vertical partitioning structure, two seats positioned against the vertical structure and separated by at least one module for storing professional and/or personal accessories, and a work surface each associated with a seat. The work surfaces are movable between a position that is distant from, and a position that is close to, the corresponding seat.

21 Claims, 5 Drawing Sheets

(56) References Cited

U.S. PATENT DOCUMENTS

| | | | | |
|---|---|---|---|---|
| D725,919 | S | 4/2015 | Hidalgo | |
| 9,622,570 | B1 * | 4/2017 | Holdredge | A47B 5/00 |
| D786,571 | S * | 5/2017 | Webb | D6/337 |
| D787,206 | S * | 5/2017 | Webb | D6/335 |
| 9,700,148 | B2 * | 7/2017 | Nguyen | A47C 13/00 |
| 2005/0012375 | A1 | 1/2005 | Glasson | |
| 2005/0140184 | A1 | 6/2005 | Williams et al. | |
| 2009/0050740 | A1 | 2/2009 | Saint-Jaimes | |
| 2009/0243352 | A1 | 10/2009 | Cailleteau | |
| 2010/0310062 | A1 | 12/2010 | Hankinson | |
| 2011/0210204 | A1 | 9/2011 | Cikkuns | |
| 2012/0318918 | A1 | 12/2012 | Johnson | |
| 2013/0031845 | A1 | 2/2013 | Ali | |
| 2013/0248653 | A1 | 9/2013 | Riynd | |
| 2013/0248654 | A1 | 9/2013 | Henshaw | |
| 2014/0159440 | A1 | 6/2014 | Porter | |

* cited by examiner

WORK AND DISCUSSION SPACE

This application is a continuation of U.S. patent application Ser. No. 15/164,157, filed May 25, 2016, which is a continuation of International Application No. PCT/FR2013/053132 filed Dec. 17, 2013 and entitled Work and Discussion Space, the entire disclosures of which are hereby incorporated herein by reference.

FIELD OF INVENTION

An arrangement of a work and discussion space includes attributes of an office, i.e. a formal space, and a lounge, i.e. an informal space. This is a space where one or more people can work in an environment that is welcoming, comfortable and suited to working.

BACKGROUND

Nowadays, people tend to move away from their office or a meeting room to other, more welcoming spaces, particularly when working collaboratively in small groups. These places may, for example, consist of lounge-type spaces, with sofas and low tables, or bar-type spaces with high stools. These spaces may not, however, be well suited to working, since the seat base may not be ergonomic, the positioning and height of the tables may not be suitable, and people tend to adopt poor posture, for example leaning forwards towards a low table on which their portable computers are placed, or putting the computers on their laps because there is no available work surface.

Studies have shown that the emotional aspect of people working in small groups is important and this is what draws them to a more welcoming and attractive place than an ordinary office or meeting room. These people are looking for a pleasant, comfortable space allowing greater freedom in group discussions and a sort of escape. These spaces allow people to relax and work in a different way, outside an overly "serious" setting, to form closer links and build trusting relationships.

This option may, however, be detrimental to the technical performance that can be offered by an office or meeting room. Such office or meeting room environments typically have ergonomic furniture, sizeable work surfaces, practical places for leaving one's bag, jacket or personal items, technological media such as power outlets, network sockets, multimedia devices etc., and a spatial environment appropriate for working, for example with acoustic insulation and a visual barrier to other adjacent offices.

SUMMARY

The present embodiments thus provide the creation of a place offering both technical performance worthy of an office or meeting room, and an informal, welcoming setting inviting people working in small groups to feel emotionally relaxed and comfortable. The idea is to find a balance between the practical, technical aspect and the emotional aspect. This place is therefore intended to allow people to do serious work while sitting comfortably in a reassuring, calm cocoon.

This place may include a work and discussion space configured with two identical installation blocks positioned facing each other, with each installation block accommodating at least two people. Each installation block includes a vertical partition structure, two seats positioned against the vertical structure and separated by at least one storage module for professional and/or personal accessories, and two work surfaces each associated with a seat and movable between a position that is distant from and a position close to the corresponding seat.

This space is therefore designed to accommodate 1 to 4 people. If there are more than 4 people conversations often become noisier and a meeting room may be more suitable for collaborative work. Each user has the advantage of a suitable, practical work surface allowing him/her to work while sitting comfortably in a recommended posture.

The two vertical structures partition off the space and may, for example, be installed in an open-plan environment. The people working in this space feel as though they are in a separate room, since their view is limited by the vertical structures around them.

In one embodiment, the vertical partition structure is U-shaped and comprises a central, linear panel set between two angular, L-shaped panels. The width of a block may be around 2400 mm, while the distance separating the central panels of the two blocks may be around 2800 mm. This distance can vary according to the positioning of the blocks facing each other. Ideally, there will be a compromise between feeling close enough for interpersonal collaboration, and having a sense of space around each person, to give a feeling of freedom and not being enclosed. Users can easily move the two blocks so as to bring them closer together or further apart, as they prefer.

People enter the work and discussion space via the free passage between the two facing angular panels, on either side of the two blocks. These two passages also allow a sensation of openness to be created in a space delimited by the two blocks.

To allow collaborative work in a calm environment, the vertical partition structure may be made from a material having sound insulation properties. This means that the four people can keep their discussions confidential even if the work and discussion space is located in an open-plan environment, for example. Conversely, the four people will not be disturbed by noise from the outside environment around the work and discussion space. This concept of acoustic comfort is very important, to allow everyone to feel at ease in the space, and to talk without producing any particular resonance or having to raise their voices to be heard.

For better acoustic comfort, and to give the impression of being cocooned, there is a border tilted towards the inside of the U shape above the upper end of the vertical partition structure. This tilted border provides a visual effect giving users the impression of being protected from the outside, and finishing off the space. The way it is oriented also allows sound waves to be reflected into the space, for improved acoustics.

As concerns the technical performance of the space, the central panel of each block constitutes a technical wall for the connection and installation of technical devices such as lighting, loudspeakers, television screens, power outlets etc. The central panel thus fulfils two main functions: to delimit the space and provide access to technical services. The electric wiring providing power to the various technical devices is routed within the thickness of the panel and is therefore not obvious from outside.

According to one possible configuration, the two seats are positioned in the two right angles defined by the angular panels, and each seat base is oriented at 45° along the bisector of the corresponding right angle. The two facing blocks form a delimited, rectangular-shaped work space on the floor, with the four people sitting in the four corners. The seat bases are therefore distributed evenly within the work space. Since the four seats are identical, no-one in the group will be given prominence by his/her position within the work space, unlike in a meeting room where the people seated at the end of the table, or the middle of the table, have a predominant position.

The idea of this even distribution of the seats is to put all the members of the group on an equal footing.

Moreover, unlike a sofa where people sit next to each other and cannot see each other directly, the 45° orientation of the seats allows the people seated to see each other directly without having to turn their heads and/or bodies. The seats are therefore arranged in twos on a diagonal in the work space and all the people seated unconsciously focus their gaze on the centre of the work space. The fact that the seats are positioned at the corners also allows each person seated to have a sense of intimacy with the other people present in the work space.

Preferably, in one embodiment, each seat is configured as a cube above which there is a seat back, the peripheral backrest wall of which is semi-circular in appearance and contained within the right angle of the corresponding angular panel, and the upper armrest wall of which slopes gradually on either side of the bisector. The angle of the cube distal from the vertical structure may be bevelled along a sloping plane perpendicular to the vertical plane containing the bisector so as to delimit the front end of the seat base with a free space underneath so that the seated person can position his/her feet. This type of semi-circular seat-back allows the people seated to be firmly positioned in their seats. They can also rest their arms comfortably on the ergonomic armrests. Finally, the users may opt to stretch out their legs into the centre of the space without getting in the way of their neighbours' legs, or fold their legs under the seat because of the free space provided for that purpose. Each seat has therefore been designed from an ergonomic point of view, to provide maximum user comfort.

According to one possibility, the storage module includes a first storage shelf located above a second storage shelf provided with electrical connection means of the power outlet type. The first shelf can prove convenient for stowing, for example, a mobile telephone or pens, i.e. items that need to be within easy reach. As for the second shelf, this is intended more for accommodating a handbag or a computer bag, for example. The positioning of the power outlets in the storage module is an alternative to positioning them in the central panel of the vertical partition structure.

Preferably, two symmetrical storage modules separate the two seats of the same installation block. In this way, each user will have his/her own storage module, as well as an individual work surface. The latter may include a small table pivoting about a shaft that is off-centre relative to the centre of the small table and secured to an element of the installation block. Because of this pivoting movement, users can easily position the small tables in front of themselves for working, or stow them to the side when not in use, thus freeing up the space.

Moreover, the fact that the shaft is off-centre prevents users from knocking their legs against it when putting the small table in front of themselves. The pivoting shaft of the small table is fixed in the storage module adjacent to the seat with which said small table is associated. However, the pivoting shaft could also be fixed to the vertical partition structure.

In the interests of ergonomics again, and to encourage a good working posture, the work surfaces have height adjustment devices. The user can therefore adjust the height of the small table according to chest size and general preferences.

Optionally, there is a roof above the work and discussion space, positioned some distance from the upper end of the two vertical partition structures. This roof helps to create the illusion of a closed room, for example, within an open-plan environment. However, to avoid a sense of being closed in, a free space is provided between the upper end of the installation blocks and the peripheral borders of the roof. This allows the work and discussion space to be ventilated to some extent.

In addition, the roof appears to be "suspended" over the work space. It may be fixed, for example, to the installation blocks by means of frames, or to the ceiling of the open-plan space.

This roof is made from a material having sound insulation properties, to reflect sound waves into the work space and absorb resonance.

For aesthetic reasons, the roof may be made from a transparent or translucent material. This allows light to pass into the room.

Likewise, the inner walls of the vertical partition structures may be decorated in different colours, with different patterns, to create a certain atmosphere matching the emotional context sought by the users.

BRIEF DESCRIPTION OF THE DRAWINGS

The embodiments will now be described in greater detail, with reference to the accompanying figures, in which.

DETAILED DESCRIPTION OF THE PRESENTLY PREFERRED EMBODIMENTS

Figure 1:
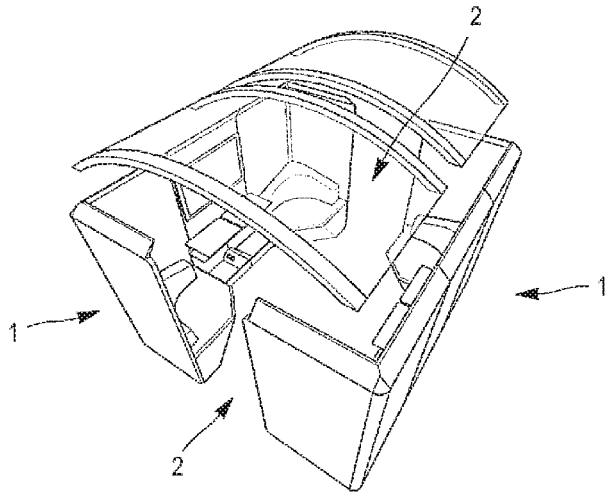
FIG. 1 is an overview of a first variant of the work and discussion space according to the invention.

With reference to FIG. 1, one embodiment of the work and discussion space includes two identical installation blocks (1), situated facing each other. These two blocks (1) recreate a work room, and can accommodate up to four people, at the four corners of the work room. These two blocks (1) are not coupled together but set apart from one another so that people are far enough apart to encourage conversations and discussions. The free space separating the two blocks (1) creates two side passages (2) for getting into the work and discussion space.

Figure 2:
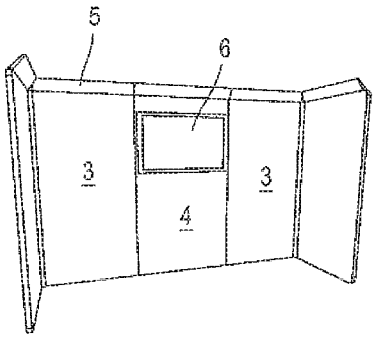
FIGS. 2 and 3 show the vertical partition structures according to the first variant.
Figure 3:
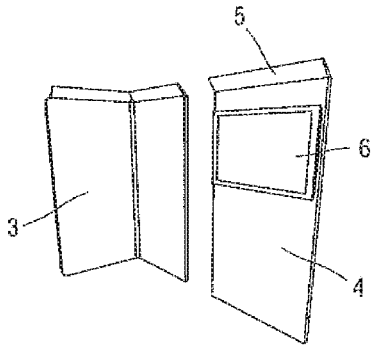

Each block (1) comprises a U-shaped vertical partition structure, as illustrated in FIG. 2, composed of a central panel (4) positioned between two L-shaped angular panels (3). These panels (3, 4) are shown separately in FIG. 3. This vertical structure is sized so as to form, in a manner of speaking, the walls of the work room, and it is preferably designed to be made of a material with sound insulation properties.

The central panel (4) is a technical panel inside which electrical wiring is routed, to supply power to various devices that can be installed on the panel (4), such as a screen (6), light fittings, loudspeakers, equipment such as network sockets or power outlets etc.

A border (5) tilted towards the inside of the work room extends the whole periphery of the upper end of the vertical structure.

Figure 4:
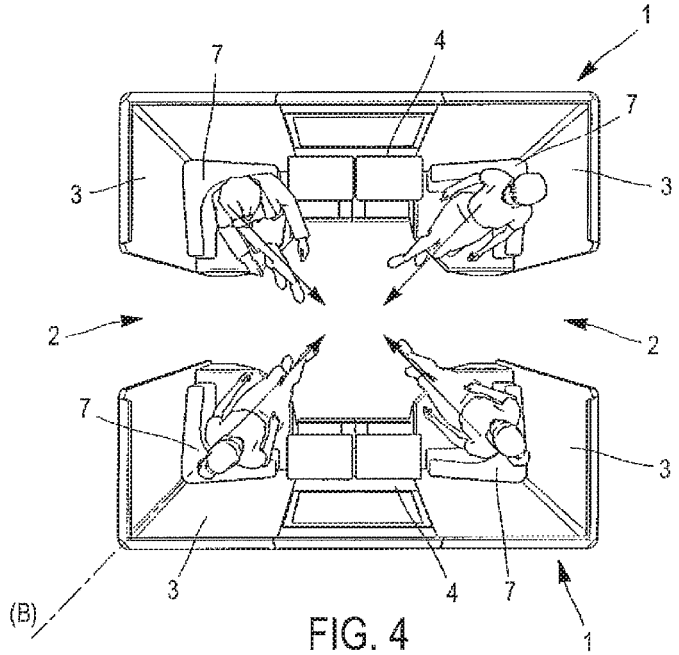
FIG. 4 is a plan view of the space, with four people seated.

The total height of the vertical structure is great enough for a person sitting or standing inside the work and discussion space not to be able to see over the vertical structure, and thus to feel protected from being seen from outside. The four people inside the space can therefore concentrate on their collaborative work and focus their gaze on the centre of the room thus created, as illustrated by the arrows in FIG. 4, particularly because their respective seats (7) are oriented on the diagonals of the room.

The seats (7) are located at the four corners defined by the two vertical structures, and the seat bases are oriented along the bisector (B) of each angle, i.e. at 45° to the walls of the angular panel (3).

Figure 5:
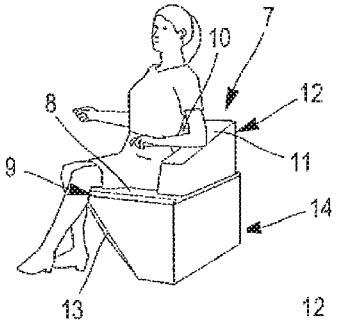
FIGS. 5 to 7 illustrate a possible configuration of a seat according to the invention.
Figure 6:
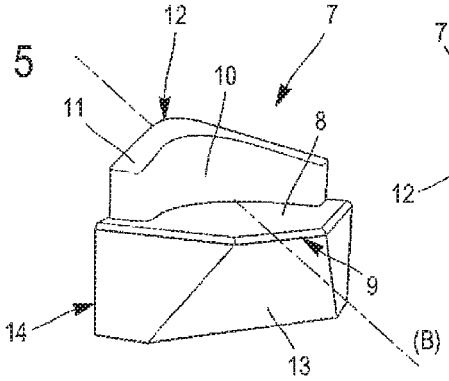

This particular orientation of the seat base is permitted by the specific design of the seat (7) as shown in FIG. 6, which consists of a cube (14) defining a seat base (8) looking like a square with a truncated corner (9), above which there is a seat back (12) bordering the two sides of the seat base (8) opposite the truncated corner (9). The inner peripheral portion (10) of the seat-back (12) is semi-circular in appearance, so as to surround the back of the user. The latter therefore sits preferably along the diagonal of the seat base (8) passing through the truncated corner (9), as illustrated in FIG. 5.

Figure 7:
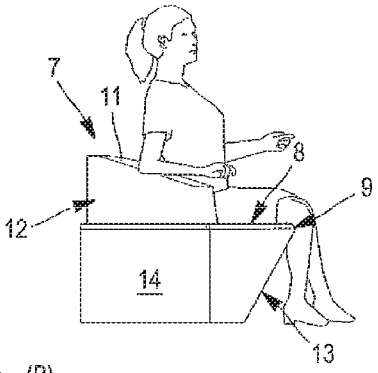

The portion of the cube (14) located below the truncated corner (9) of the seat base (8) is bevelled along a sloping plane (13) perpendicular to the vertical plane containing the bisector (B) of the right angle in which the seat (7) is positioned. This bevelling (13) allows users to bend their legs and position their feet under the seat base (8) for greater comfort (see FIG. 7).

The upper wall (11) of the seat back (12) slopes gradually downwards on either side of the bisector (B), to provide better arm support for the user.

Figure 8:
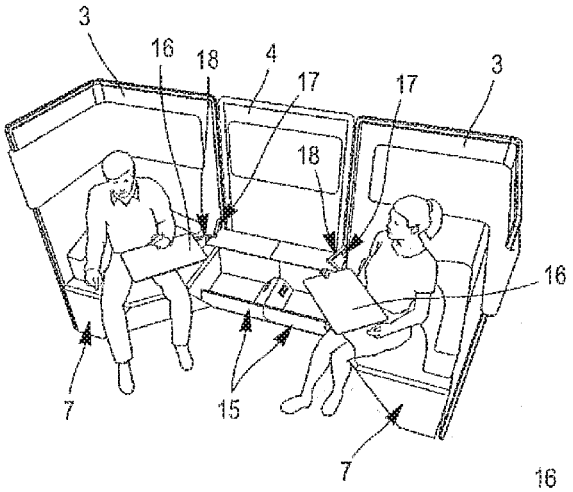
FIGS. 8 to 10 show the various possible positions of the work surfaces for each user.
Figure 9:
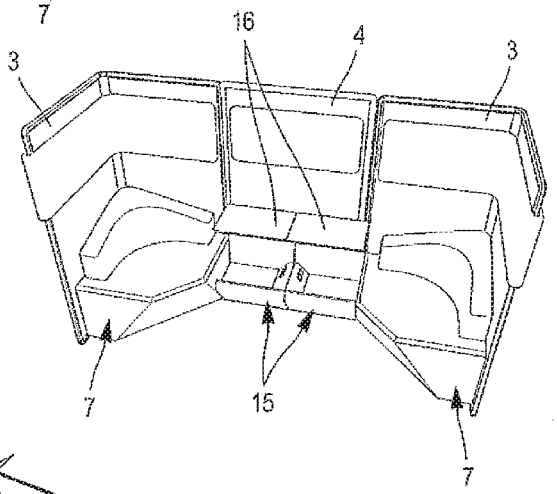
Figure 10:
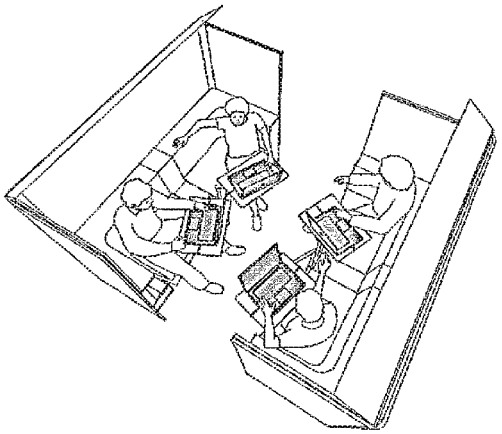

For each block (1), two storage modules (15) are coupled together and placed flush against the central panel (4), thus separating the two seats (7). These storage modules (15) each support a small table (16) pivoting on a pivoting shaft (17) fixed into the upper portion of the corresponding module (15). This shaft (17) is connected to the small table (16) by an articulated arm (18), and is therefore off-centre relative to the centre of the small table (16) so as not to knock against the legs of users when the latter position the small table (16) in front of themselves, as in FIG. 8. FIG. 9 shows the small tables (16) in the stowed position, thus giving access to the seats (7). These small tables (16) serve mainly as work surfaces for the users. They can, for example, put their portable computers on them, as illustrated in FIG. 10.

The pivoting shaft (17) is telescopic, so that the user can adjust the height of the small table (16).

Figure 11:
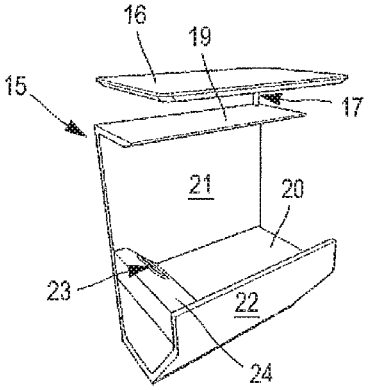
FIGS. 11 and 12 illustrate an example of a storage module according to the invention.
Figure 12:
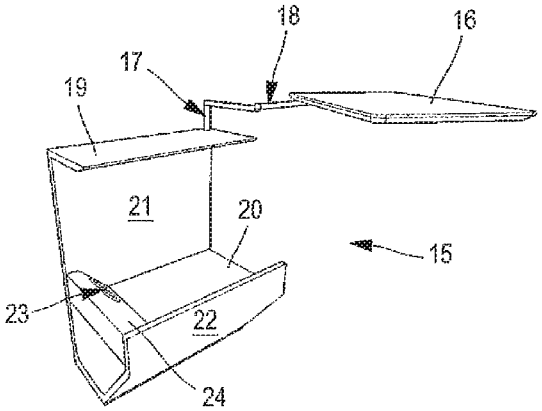

The storage module (15) is illustrated more specifically in FIG. 11 with the small table (16) stowed, and in FIG. 12 with the small table (16) deployed. This module (15) comprises a first shelf (19) located over a second shelf (20). The two shelves (19, 20) are connected by means of a side panel (21) intended to be placed flush against the vertical structure.

The second shelf (20) is provided with power outlets (23) that can be positioned on a sloping portion (24) of the shelf (20) so as to face towards the user and be easy to access for electrical connection. These power outlets (23) are connected by means of electrical wiring routed within the volume located under the second shelf and hidden by an outer facade (22). This volume can also contain ballast, to give the module (15) greater stability, particularly when the small table (16) is being manipulated and the power outlets (23) are being used by the user.

Figure 13:
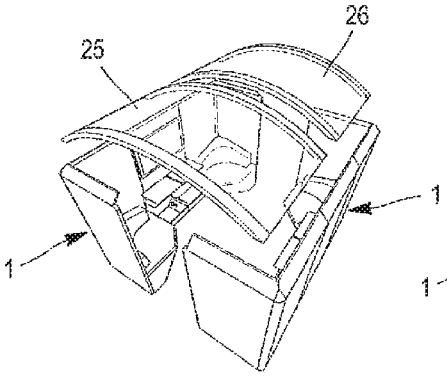
FIGS. 13 to 15 illustrate three types of roof above the work and discussion space.
Figure 14:
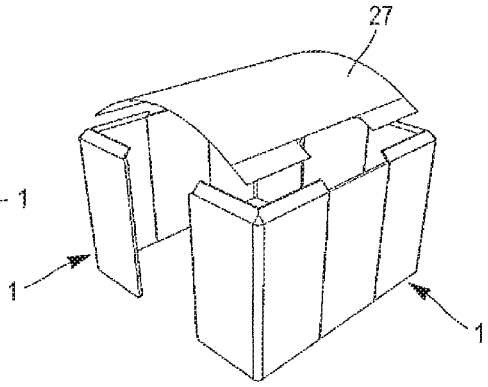
Figure 15:
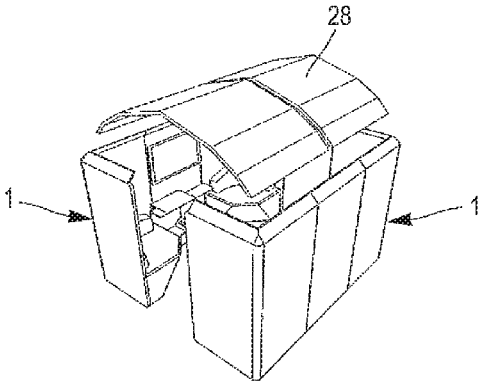

Finally, FIGS. 13 to 15 illustrate three possible variants of a roof covering the work and discussion space. This roof is always positioned some distance from the upper portion of the blocks (1).

In FIG. 13 the roof is made up of two concave, transparent assemblies (25, 26). In FIG. 14 the roof (27) is in a single, concave piece, made of opaque material. In FIG. 15 the roof (28) is also in a single piece and designed as an opaque material, and is made from a flat sheet folded in various places to give it a rounded appearance.

Figure 16:
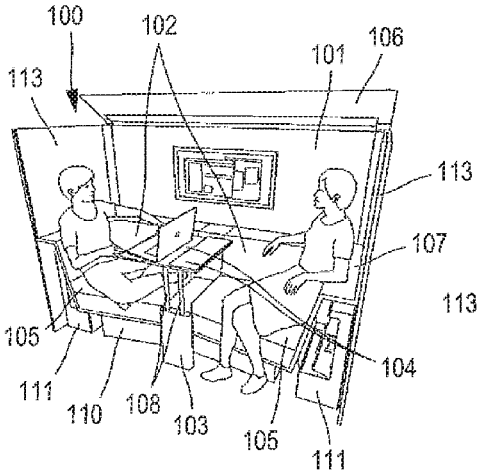
FIGS. 16 to 19 show a second variant of the work and discussion space.
Figure 17:
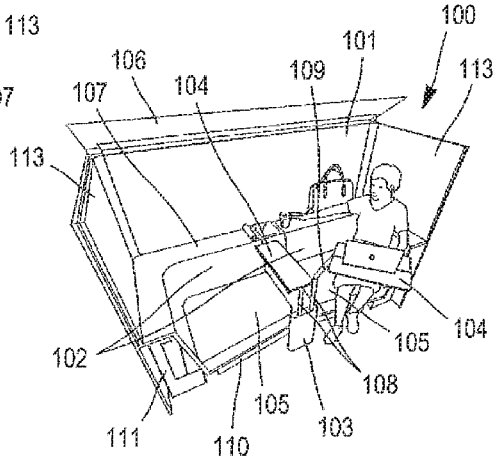
Figure 18:
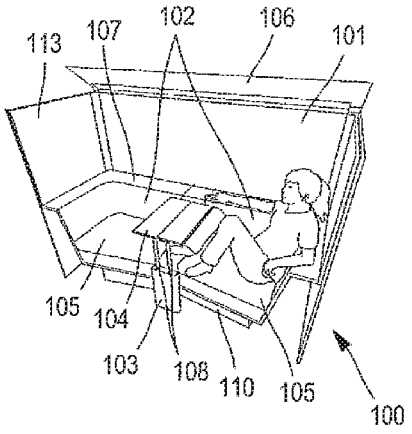

FIGS. 16 to 18 offer a second variant of the work and discussion space. In this variant, each block (100) comprises a vertical partition structure composed of a central technical panel (101), set between two side panels (113) oriented perpendicular to the central panel (101). A canopy (106) attached to the central panel (101) shelters two seats (112) located underneath and positioned against the vertical structure.

Figure 19:
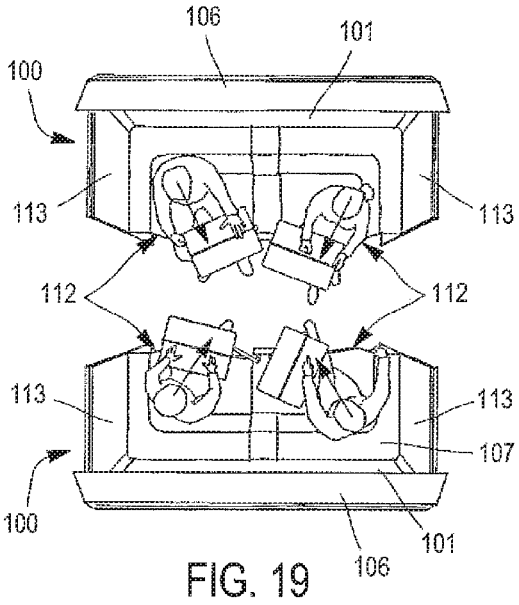

A ledge (107) located at armrest height extends the whole length of the vertical partition structure. This ledge (107) is therefore U-shaped, and merges with the upper armrest wall of the two seat-backs (102) of the seat (112) belonging to the block (100). The two seat-backs (102) are connected to each other and appear continuous, to resemble the seat-back of a sofa. As for the two seat bases (105) of the seats (112), they are separated by a central storage module (103) supporting two small tables (104) pivoting by means of a mechanical link of the type with a telescopic shaft (108) and an articulated arm (109). These two small tables (104) can be arranged against each other, perpendicular to the seat back (102) as illustrated in FIGS. 16 and 18, or deployed in front of the user as illustrated in FIGS. 17 and 19.

Each small table (104) is made up of two parts articulated by a central hinge, so that it can be folded to take up the minimum amount of space, or unfolded if the user needs a larger work surface.

The seats (112) are cubic in appearance, with a recess in the area of the pedestal (110) allowing users to position their feet under the seat base (105). The latter is slightly truncated in its front portion, so that the user tends to turn slightly towards the centre of the room when sitting, as illustrated in FIG. 19, without, however, adopting an orientation along the bisectors of the angles of the room as was the case in the first variant.

Finally, a sliding drawer (111) is provided in each side panel (113), under the ledge (107). This drawer (111) is in the closed position in FIG. 16, and can slide along the side panel (113) to an open position (not shown). It comprises an upper shelf and a lower platform suitable for accommodating a handbag or computer bag, for example.

The configurations shown in the aforementioned figures are merely possible examples of the invention, which is not in any way limited by them and which on the contrary encompasses the form and design variants available to the person skilled in the art.

The invention claimed is:

1. A work and discussion space comprising:

a pair of freestanding U-shaped vertical partition structures having a back wall and a pair of opposite side walls, wherein each of said U-shaped vertical partition structures has a floor engaging portion adapted to be supported by a floor, wherein said U-shaped vertical partition structures are positioned facing each other so as to define an interior space there between, and wherein at least one proximate pair of said side walls of said facing U-shaped vertical partition structures define a free passage between said U-shaped vertical partition structures into said interior space on at least one side of said interior space;

a pair of opposing seating structures, said seating structures positioned against respective ones of said U-shaped vertical partition structures and facing inwardly toward a middle of said interior space, wherein each of said seating structures comprises seating surfaces positioned in respective corners of said U-shaped vertical partition structures, wherein each of said seating structures comprises a curved backrest wall disposed within each of said corners, wherein said corners each have a bisector extending diagonally inwardly into said interior space, and each of said curved backrest walls has a centerline aligned with one of said bisectors, and wherein each of said seating structures has a floor engaging base adapted to be supported by the floor, and wherein said seating structures and said U-shaped vertical partition structures are adapted to be separately supported on the floor by said floor engaging bases and said floor engaging portions respectively; and at least one work surface positioned in said interior space between said opposing seating structures.

2. The work and discussion space according to claim 1 wherein said U-shaped vertical partition structure comprises a central, linear panel set between two angular, L-shaped panels.

3. The work and discussion space according to claim 1 wherein the backrest wall comprises a downwardly sloping upper armrest surface.

4. The work and discussion space according to claim 1, wherein said at least one work surface comprises a table pivoting about a shaft positioned off-centre relative to a centre of said table, wherein said shaft is coupled to a storage module positioned in said interior space.

5. The work and discussion space according to claim 1 wherein said U-shaped vertical partitions are moveable toward and away from each other.

6. The work and discussion space according to claim 1, wherein each of said seating structures comprises a seat back extending along at least one of said side walls and said back wall of said U-shaped vertical partition structure.

7. The work and discussion space according to claim 1 wherein at least one of seating structures comprises a pair of seats arranged in said corners of a respective one of said U-shaped vertical partition structures, said pair of seats defining said seating surfaces.

8. The work and discussion space according to claim 1 wherein said work surface is moveable from a stored position to a working position, wherein said work surface is positioned in said interior space between said opposing seating structures when in said working position.

9. The work and discussion space according to claim 1 wherein said vertical partition structure extends below a bottom of said curved backrest wall.

10. A work and discussion space comprising:

a pair of freestanding U-shaped vertical partition structures having a back wall and a pair of opposite side walls, wherein each of said U-shaped vertical partition structures has a floor engaging portion adapted to be supported by a floor, wherein said U-shaped vertical partition structures are positioned facing each other so as to define an interior space there between, and wherein proximate pairs of said side walls of said facing U-shaped vertical partition structures define a pair of free passages between said U-shaped vertical partition structures into said interior space on opposite sides of said interior space;

a seating structure positioned against at least one of said U-shaped vertical partition structures and facing inwardly toward a middle of said interior space, wherein said seating structure comprises seating surfaces positioned in respective corners of said U-shaped vertical partition structures, wherein each seating surface comprises a seat back comprising a curved portion extending along at least one of said side walls and said back wall of said U-shaped vertical partition structure, said at least one side wall and said back wall having a bisector extending diagonally inwardly into said interior space, and said curved portion of said seat back defined by a centerline aligned with said bisector, and wherein said seating structure has a floor engaging base adapted to be supported by the floor, and wherein said seating structure and said U-shaped vertical partition structures are adapted to be separately supported on the floor by said floor engaging bases and said floor engaging portions respectively; and at least one work surface positioned against at least another of said U-shaped vertical partition structures opposite said at least one of said U-shaped vertical partition structures.

11. The work and discussion space according to claim 10 further comprising a clear passageway defined between and connecting said pair of free passages.

12. The work and discussion space according to claim 10 wherein said at least one work surface is movable between a position that is distant from and a position close to said another of said U-shaped vertical partition structure.

13. The work and discussion space according to claim 10, wherein said at least one work surface is pivotable about a vertical axis shaft between said distant and close positions.

14. The work and discussion space according to claim 10, wherein said at least one work surface is height adjustable.

15. The work and discussion space according to claim 10, wherein said U-shaped vertical partition structures are moveable toward and away from each other.

16. The work and discussion space according to claim 10 wherein each of said U-shaped vertical partition structures comprises a central panel positioned between and coupled to a pair of said side walls, each of said side walls having a vertical edge defining a border of one of said free passages, wherein said side wall has a height defined at said vertical edge that is the same as a height of said central panel.

17. The work and discussion space according to claim 10 wherein said vertical partition structure extends below a bottom of said seat back.

18. A work and discussion space comprising:

a pair of freestanding U-shaped vertical partition structures having a back wall and a pair of opposite side walls, wherein each of said U-shaped vertical partition structures has a floor engaging portion adapted to be supported by a floor, wherein said U-shaped vertical partition structures are positioned facing each other so as to define an interior space there between, and wherein at least one proximate pair of said side walls of said facing U-shaped vertical partition structures define a free passage between said U-shaped vertical partition structures into said interior space on at least one side of said interior space; and a seating structure positioned against at least one of said U-shaped vertical partition structures and facing inwardly toward a middle of said interior space, wherein said seating structure comprises a seat back extending along said side walls and said back wall of said U-shaped vertical partition structure and seating surfaces positioned in respective corners of said U-shaped vertical partition structures, wherein said seat back comprises a curved backrest wall disposed within each of said corners, wherein said corners each have a bisector extending diagonally inwardly into said interior space, and each of said curved backrest walls has a centerline aligned with a corresponding one of said bisectors, and wherein said seating structure has a floor engaging base adapted to be supported by the floor, and wherein said seating structure and said U-shaped vertical partition structures are adapted to be separately supported on the floor by said floor engaging bases and said floor engaging portions respectively; and at least one work surface positioned against at least another of said U-shaped vertical partition structures opposite said at least one of said U-shaped vertical partition structures.

19. The work and discussion space according to claim 18 wherein proximate pairs of said side walls of said facing U-shaped vertical partition structures define a pair of free passages between said U-shaped vertical partition structures into said interior space on opposite sides of said interior space, wherein a clear passageway is defined between and connects said pair of free passages.

20. The work and discussion spaced according to claim 18 wherein said U-shaped vertical partition structures are moveable toward and away from each other.

21. The work and discussion space according to claim 18 wherein said vertical partition structure extends below a bottom of said seat back.

* * * * *